US005496262A

United States Patent [19]

Johnson, Jr. et al.

[11] Patent Number: 5,496,262

[45] Date of Patent: Mar. 5, 1996

[54] THERAPEUTIC INTERMITTENT COMPRESSION SYSTEM WITH INFLATABLE COMPARTMENTS OF DIFFERING PRESSURE FROM A SINGLE SOURCE

[75] Inventors: Glenn W. Johnson, Jr., Summit; Henry J. McVicker, Chatham; Mark J. McCarthy, Warren, all of N.J.

[73] Assignee: Aircast, Inc., Summit, N.J.

[21] Appl. No.: 505,520

[22] Filed: Jul. 25, 1995

Related U.S. Application Data

[63] Continuation of Ser. No. 177,916, Jan. 6, 1994, abandoned.

[51] Int. Cl.[6] ..... A61H 9/00

[52] U.S. Cl. ..... 601/152; 601/150; 128/DIG. 20; 602/13

[58] Field of Search ..... 601/148–152; 602/13; 128/DIG. 20

[56] References Cited

U.S. PATENT DOCUMENTS

| | | | |
|---|---|---|---|
| 2,880,721 | 4/1959 | Corcoran | 601/151 |
| 3,865,103 | 2/1975 | Folman | 601/152 |
| 3,901,225 | 8/1975 | Sconce | 602/13 |
| 4,029,087 | 6/1977 | Dye et al. | 601/152 |
| 4,066,084 | 1/1978 | Tillander | 601/149 |
| 4,091,804 | 5/1978 | Hasty | 601/152 |
| 4,206,751 | 6/1980 | Schneider | 601/152 |
| 4,827,912 | 5/1989 | Carrington et al. | 601/152 |
| 5,125,400 | 6/1992 | Johnson, Jr. | 602/13 |

FOREIGN PATENT DOCUMENTS

| | | | |
|---|---|---|---|
| 852328 | 8/1981 | U.S.S.R. | 601/152 |

*Primary Examiner*—Richard J. Apley
*Assistant Examiner*—Jeanne M. Clark

[57] ABSTRACT

A system for intermittent, sequential, graduated compression of a multicompartment inflatable cuff by means of a single pulsing air pump and a single air tube connecting the pump to the cuff. Each more proximal compartment is inflated through a fluid restrictor communicating with its adjacent more distal compartment. The maximum pressure in the most proximal compartment is limited by a fluid restrictor bleeding air to atmosphere and the pressure in the most proximal compartment is always less than the pressure in the adjacent more distal compartment. The maximum pressure in the most distal compartment is controlled by a pressure relief valve. In a second embodiment, deflation is through a restrictor located in the supply line to the cuff and deflation of each more proximal compartment is through a one-way check-valve that permits flow of air from a proximal compartment to a distal compartment but not in the reverse direction.

18 Claims, 5 Drawing Sheets

THERAPEUTIC INTERMITTENT COMPRESSION SYSTEM WITH INFLATABLE COMPARTMENTS OF DIFFERING PRESSURE FROM A SINGLE SOURCE

CROSS-REFERENCE TO RELATED APPLICATION

This is a continuation of application Ser. No. 08/177,916 filed on Jan. 6, 1994, now abandoned.

FIELD OF THE INVENTION

The present invention relates generally to a system for applying intermittent pneumatic compression to the body of a person and in particular to a therapeutic intermittent compression system including a cuff with inflatable compartments of differing pressures received from a single pressure source.

BACKGROUND OF THE INVENTION

Intermittent pneumatic compression is known to be effective not only for prevention of thrombi in the deep veins after surgery but also for management of edema and circulatory complications of the veins of the leg. However, functional requirements for the two applications differ.

For the prevention of deep vein thrombi (DVT), inflation of the leg cuff should be rapid, with pressures rising to 35 or 40 millimeters Hg in ½ second or less. This is because thrombi are believed to originate from the pooling of stagnate blood in deep veins after trauma or surgery. Intermittent compression is thus believed to prevent thrombi formation by the mechanical flushing of the stagnate blood, and studies show that rapid inflation of a leg cuff is more effective in increasing the velocity of the blood. In commonly assigned copending U.S. application Ser. No. 08/088,895, filed Jul. 8, 1993, such a system for DVI prevention is disclosed. The system employs one or more reservoirs to accumulate air compressed to relatively high pressure during the interval between pulses. On initiation of the pulse, the cuffs inflate rapidly.

In the management of edema and venous stasis, however, such rapid inflation is unnecessary. However, it is important that the pulsating compression be applied sequentially from the distal to the proximal zones of the limb and at progressively less pressure, in order to "milk" the edema toward the heart. Systems that provide such compression are well known in the art. All such known systems achieve this sequential compression by the use of a complex multistage controller containing a separate valve and air tube for each segment of the extended cuff device. Thus, a two-segment prior art cuff would have two tubes leading from the controller to the cuff and a three-segment cuff would require three tubes leading from the controller to the cuff. Such systems are very complex and are notoriously expensive. Accordingly, these devices are often available only at a hospital or clinic that patients must visit for periodic treatment instead of having the treatment in the convenience of their home.

One such system appears to be shown in Hasty U.S. Pat. No. 4,013,069. It discloses an intermittent compression device with six compartments, divided into three adjacent pairs. Each pair is inflated at present times of $t^0,t^1,t^2$ by three separate timers and shift valves. Inflation of the second compartment of each pair is through a restrictor communicating with its mating first compartment. This delays inflation of the second compartment, but its pressure ultimately rises to the same level as the first compartment. Thus these restrictors provide sequential but not graduated compression of the second compartment of each pair. All of these restrictors are located in the manifold of the controller, and each compartment of the cuff requires a separate air tube from the controller for its inflation. Thus with Hasty, six tubes are required for a six compartment cuff. All of the many sequential systems known to applicants are believed to be like this. All require a separate inflating tube for each cuff compartment. Moreover, a larger pump also is required for the larger volume of air; and, because of the structure of the cuff compartment, with no outside hard shell to restrict outward cuff expansion, there is wasted energy and efficiency.

SUMMARY OF THE INVENTION

It is therefore an object of the present invention to provide a novel and far simpler system for graduated, sequential intermittent compression of a multicompartment cuff from a single-stage pump and a single tube. It is also an object to have a system that provides this graduated, sequential intermittent compression in a leg support that functions not only when connected to the pump, but also when the tube to the pump is disconnected and the patient is walking with the leg support.

The present invention utilizes a compression cuff that is ideally similar to those disclosed in commonly assigned U.S. Pat. No. 4,280,489. Such cuff includes a pair of relatively rigid side wall members that are coextensively lined with cushioning means, such as air cells. The air cells preferably contain porous compressible fillers, as disclosed in commonly assigned U.S. Pat. No. 4,628,945, and also include multiple compartments as disclosed in commonly assigned U.S. Pat. No. 5,125,400. Each of the U.S. Pat. Nos. 4,280,489, 4,628,945, and 5,125,400 are incorporated herein in their entirety by reference.

U.S. Pat. No. 5,125,400 discloses a pneumatic brace having air cells with at least a first and second chamber, where the first chamber is coextensive with the length of the side wall member and the second chamber is coextensive with only the distal portion of the side wall member. It has been shown that this arrangement can provide therapeutic compression of the limb that is graduated with higher pressure under the distal compartment then under the proximal compartment. When walking with the pneumatic brace, the pressure pulsates, rising and falling with the muscle contraction of each step. Numerous investigators have described the effectiveness of this pulsating compression as being caused by a "milking away" of the edema that often follows ankle trauma. This highly desirable pulsation is, of course, absent when the patient is immobile.

The present invention remedies this problem by providing graduated pulsating compression to the affected limb whether the patient is mobile or immobile. This is done by modifying one of the air cells, preferably from the medial side, so that it is inflated and deflated in a completely novel way. Surprisingly, it has been found that even though only the air cells on one side of the brace are inflated, the amount of compression to the limb on the uninflated side of the brace closely follows and is similar to the compression on the inflated side. Inflating the air cell on only the one side thus greatly simplifies the system, without compromising its effectiveness.

In a first simplified embodiment of the present invention, an intermittent pressure source such as an air pump is coupled to an inflatable chamber for inflating and deflating the chamber with intermittent pressure pulses to apply pressure to the associated body portion. A fluid restrictor is provided in fluid communication between the chamber interior and the atmosphere such that the pressure in the chamber essentially dissipates between the intermittently applied pressure pulses.

In the preferred embodiment, at least two inflatable chambers are utilized. A pressure source provides intermittent pressure pulses through a single air tube to a first one of the inflatable chambers for inflating the first chamber at a predetermined rate during a first inflating cycle. A first fluid restrictor couples air under pressure from the first chamber to the second chamber, such that the rate of inflation of the second chamber is less than the rate of inflation of the first chamber thus providing a graduated, sequential intermittent compression to the associated limb.

In still another embodiment, a plurality of inflatable chambers are utilized with a fluid bleed means such as a fluid restrictor coupling each of the adjacent chambers such that the rate of inflation of each chamber decreases with the last chamber having the lowest rate of inflation so as to cause a graduated, sequential intermittent compression by the plurality of chambers.

In each such embodiment, the last chamber has a restrictor fluid coupled between the final chamber and atmosphere such that all of the chambers deflate between the pressure pulse cycles.

In yet another embodiment, the last chamber may have a one-way check-valve disposed between adjacent compartments that permits air to pass freely back toward the first compartment from the last compartment but not from the first compartment to the last compartment. With this arrangement, the fluid restrictor to atmosphere is relocated from the last inflatable compartment to a three way connector between the air pump and the inlet tube. Inflation of the last compartment is delayed through the first fluid restrictor, but during the deflation cycle the one-way valve opens permitting more rapid deflation of the last compartment through the first compartment and then to atmosphere.

Thus, there is provided a novel and simple system that allows graduated, sequential intermittent compression of a multicompartment cuff from a single-stage pump and a single tube.

It is also an object of the present invention to provide graduated, sequential intermittent compression in a leg support not only when the leg support is connected to an air pump, but also when support is disconnected from the tube to the air pump and the patient is walking with the support on.

It is yet another object of the present invention to provide a system for intermittent, sequential, graduated compression with a multicompartment inflatable cuff where each more proximal compartment is inflated through a restrictor communicating with its adjacent more distal compartment.

It is still another object of the present invention to provide an intermittent, sequential, graduated compression system with a multicompartment inflatable cuff wherein the maximum pressure in the most proximal compartment is limited by a restrictor that bleeds the compartment is always less then the pressure in the adjacent but more distal compartment.

It is yet another object of the present invention to provide a system for intermittent, sequential, graduated compression with a multicompartment inflatable cuff wherein the maximum pressure in the most distal compartment is controlled by a pressure relief valve.

It is also an object of the present invention to provide a system for intermittent, sequential, graduated compression with a multicompartment inflatable cuff which is coextensive with the cushioning means of an ankle stirrup as disclosed in commonly assigned U.S. Pat. Nos. 4,280,489, or 5,125,400 so that the intermittent compression is provided whether connected to the air pump or when disconnected from the air pump, when the patient is walking.

It is a further object of the present invention to provide a system for intermittent, sequential, graduated compression of a multicompartment inflatable cuff wherein deflation of the compartments is through a restrictor located in the supply line to the cuff and the deflation of the each more proximal compartment is through a one-way check-valve that permits a flow of air from a proximal compartment to a distal compartment but not the reverse.

Thus, the present invention relates to a therapeutic intermittent compression system comprising an inflatable chamber for pressure engagement with at least a portion of an associated body, an intermittent pressure source coupled to the chamber with a single tube for inflating and deflating the chamber with intermittent pressure pulses to apply pressure to the body portion intermittently and a restrictor tube in fluid communication between the chamber and the atmosphere such that pressure in the chamber essentially dissipates between the intermittent pressure pulses.

The invention also relates to a therapeutic intermittent compression system comprising at least two inflatable chambers, a pressure source for providing intermittent pressure pulses, a single air tube coupling the pressure pulses to a first one of the inflatable chambers for inflating the first chamber at a predetermined rate during a first cycle, and a first fluid bleed valve coupling at least two chambers such that the rate of inflation of the second one of the chambers is less than the rate of inflation of the first one of the chambers.

BRIEF DESCRIPTION OF THE DRAWINGS

These and other objects of the present invention will be more fully understood from the following DETAILED DESCRIPTION OF THE DRAWINGS in which like numerals represent like elements and in which.

DETAILED DESCRIPTION OF THE DRAWINGS

Figure 1:
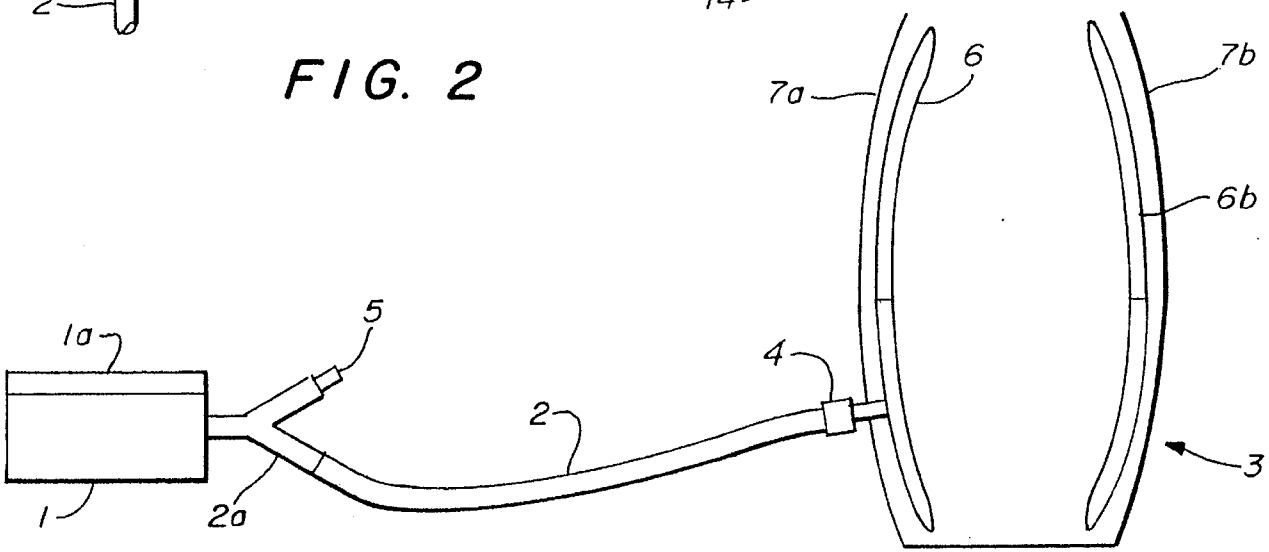
FIG. 1 is a simplified schematic representation of the preferred form of the present invention.

FIG. 1 is a schematic diagram of the simplest form of the present invention. Air pump 1 may be of the type used to aerate aquariums and is modified with an internal solid state timer 1a that turns the pump on intermittently, as disclosed in greater detail in commonly assigned copending application Ser. No. 07/968,287, filed Oct. 29, 1992, entitled Automatic Fluid Circulating System and Method, which is incorporated herein by reference in its entirety. An air tube 2 of flexible plastic connects the air pump 1 to a leg brace 3, via coupling 4. A pressure relief valve 5 is conveniently located in the Y connection 2*a* between the air pump 1 and the air tube 2.

The leg brace 3 of the present invention has the inflatable chambers in air cell 6 on the medial side and a sealed air cell 6*b* on the lateral side of the leg. Rigid side wall members 7*a* and 7*b* may be those such as are described in commonly assigned U.S. Pat. No. 4,280,489. When a pressurizing pulse is applied to the inflatable air cell 6 by pump 1, the pressure rises to a maximum, as illustrated by waveform X in FIG. 4. When the air pump pressure ceases, the air is bled from cell 6 through a restrictor or bleed valve (not shown) and the pressure falls as indicated by the letter Y in FIG. 4. This cycle simply repeats itself as shown.

Figure 2:
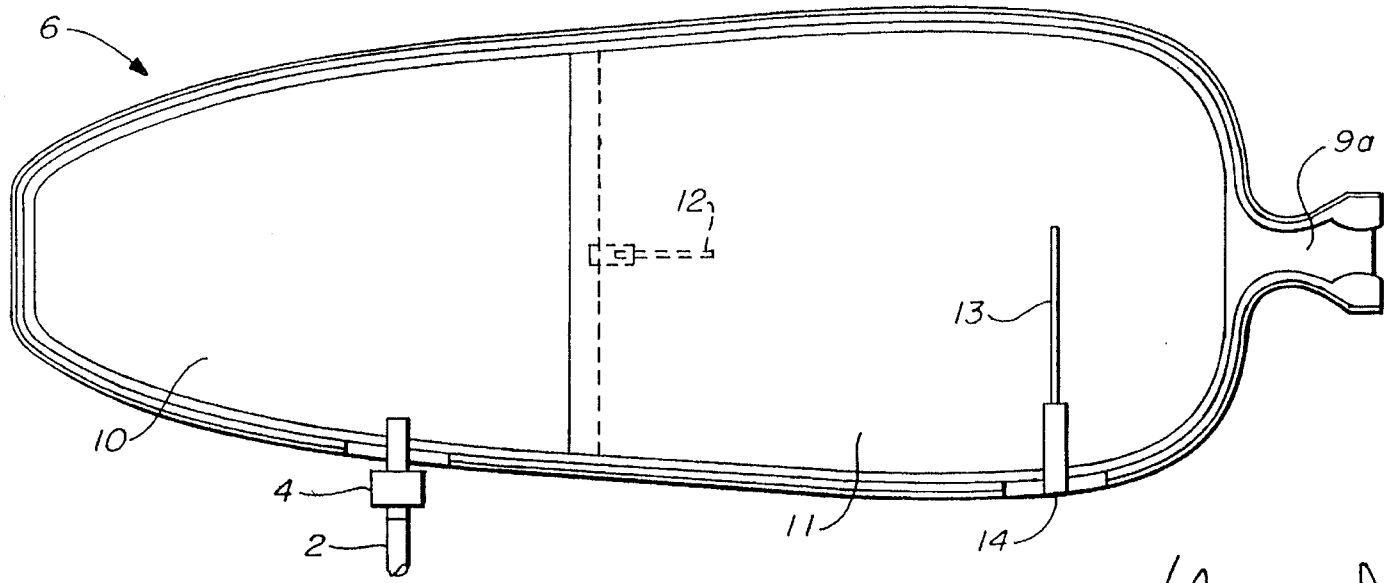
FIG. 2 is a plan view of the preferred embodiment of a multicompartment air cell that is attached to the inner surface of an upright ankle brace and which contains a first inflatable sealed chamber and a second inflatable sealed chamber with a restrictor tube coupling the first and second inflatable sealed chambers and a second restrictor tube coupling the second chamber to atmosphere.

FIG. 2 is a plan view of the preferred embodiment of the multicompartment or multichambered air cell 6, that is attached to the inner surface of upright shell wall 7*a* of ankle brace 3 shown in FIG. 1. The air cell 6 generally is of the type disclosed in FIG. 12 of commonly assigned U.S. Pat. No. 5,125,400, and is shown in cross section in FIG. 3 herein. It includes a first sealed chamber 8 enclosed in a second larger chamber 9 that can be orally inflated through a self-sealing valve 9*a*. The chamber 9 is generally coextensive to the shell wall 7*a*.

Figure 3:
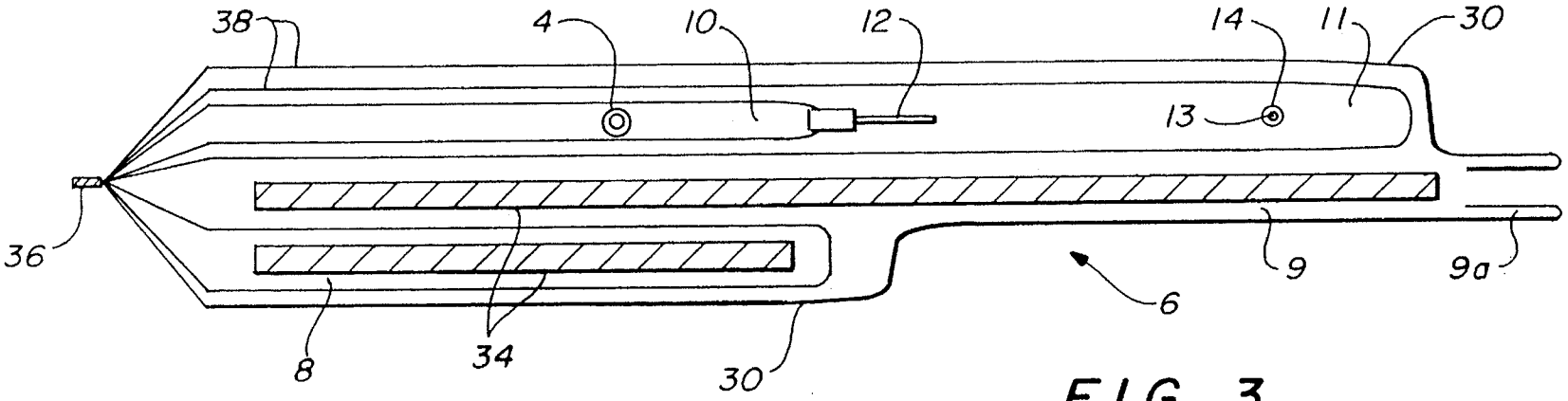
FIG. 3 is a cross-sectional view of the air cell of the preferred embodiment shown in FIG. 2.

Two additional inflatable chambers 10 and 11, shown in plan view in FIG. 2 and in cross section in FIG. 3, are enveloped by and included within chamber 9. The chamber 9 may be preinflated or adjustably inflated via valve 9*a* (as more particularly detailed in applicant's commonly assigned U.S. Pat. No. 4,287,920). Chamber 10 is enclosed within chamber 11 and is inflated by air pump 1 through connection 2*a*, air tube 2. The air tube 2 connects via coupling 4 in the distal chamber 10. A restrictor tube 12 is sealed within chamber 10 and communicates with chamber 11. A second restrictor tube 13 is sealed into the edge of chamber 11 and communicates with the atmosphere at 14, as shown in FIG. 2.

In the cross section of FIG. 3, it can be seen that the outer chamber 9 is formed with an outer layer 30 that is preferably of 0.012 inches pvc film. The sealed chamber 8 enclosed within the chamber 9 has a urethane foam layer 34 therein. Another layer of urethane foam is placed in chamber 9 between the chamber 8 and the chamber 11. The inflatable chamber 10 may be formed of, for example, 0.004 pvc film 38 and the inflatable chamber 11 also may be formed of 0.004 pvc film 38. The chamber 10 is enclosed within chamber 11 and chamber 11 is enclosed within chamber 9. The outer ends of all the chambers are sealed together with, for example, an RF seal as indicated at 36.

Figure 4:
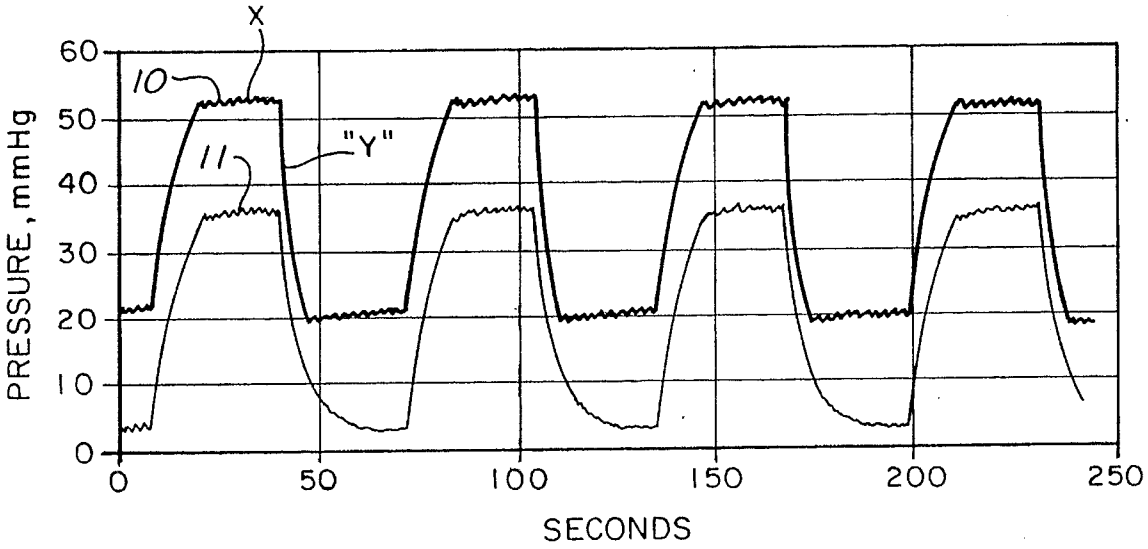
FIG. 4 is a graph illustrating a typical pressure curve achieved with operation of the preferred system of FIG. 2, having the two inflatable chambers.

FIG. 4 is a graph that illustrates a typical pressure curve achieved with the operation of this embodiment when attached to the leg of person. Air pump 1 is turned on by timer 1*a* for approximately 30 seconds of each minute. Air flows through tube 2 to chamber 10 which quickly inflates to the preset pressure of pressure relief valve 5 (for example, 50 millimeters Hg). Simultaneously, air continuously flows from the first inflatable chamber 10 through the restrictor 12 to the second inflatable chamber 11, but at a reduced rate of flow. Simultaneously, air flows out of the chamber 11 to atmosphere at 14 through the restrictor 13. When the air pump 1 is turned off, the air in both chambers 10 and 11 continues to flow to atmosphere through restrictor 13 to outlet 14 and the pressure drops and the chambers 10 and 11 deflate.

It has been found that when inlet port 4 is about 0.156" inside diameter, and first restrictor 12 is a tube of 0.031 inches inside diameter and 0.875 inches long, and second restrictor 13 is a tube of 0.031 inches inside diameter and 3.75 inches in length, and relief valve 5 is set at about 50 mm Hg, the pressure in chamber 10 will rise to about 50 mm Hg and in chamber 11 to about 35 mm Hg as illustrated at $x^1$ in FIG. 4. When the pump is turned off, the air pressure in both chambers falls rapidly as indicated at y and $y^1$ in FIG. 4.

Figure 5:
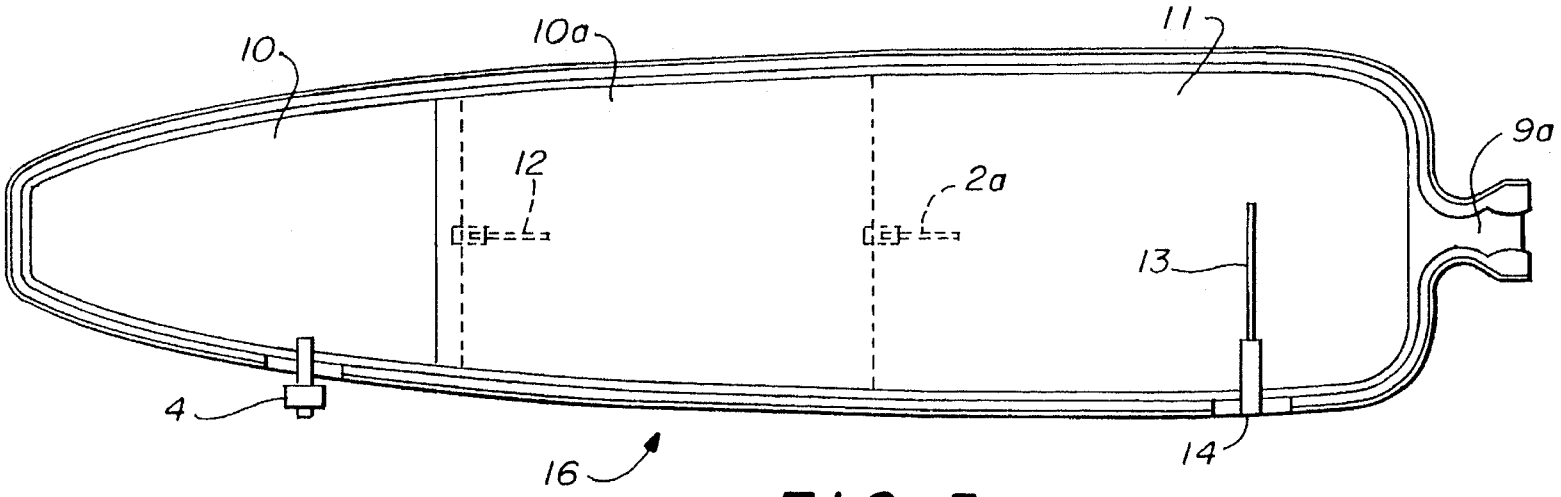
FIG. 5 is a plan view of another embodiment, depicting a three inflatable chamber cuff.
Figure 6:
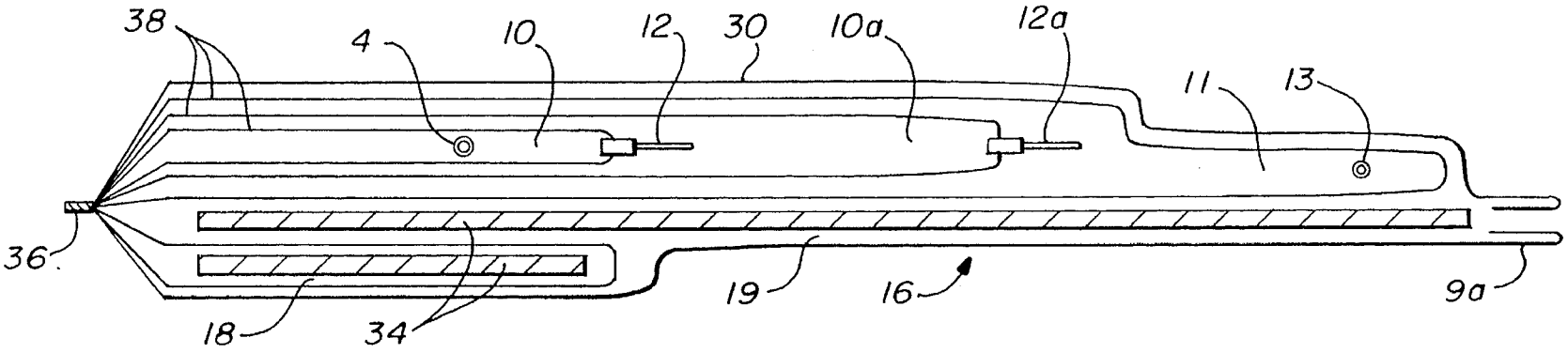
FIG. 6 is a cross-sectional view of the three-chamber cuff shown in FIG. 5.
Figure 7:
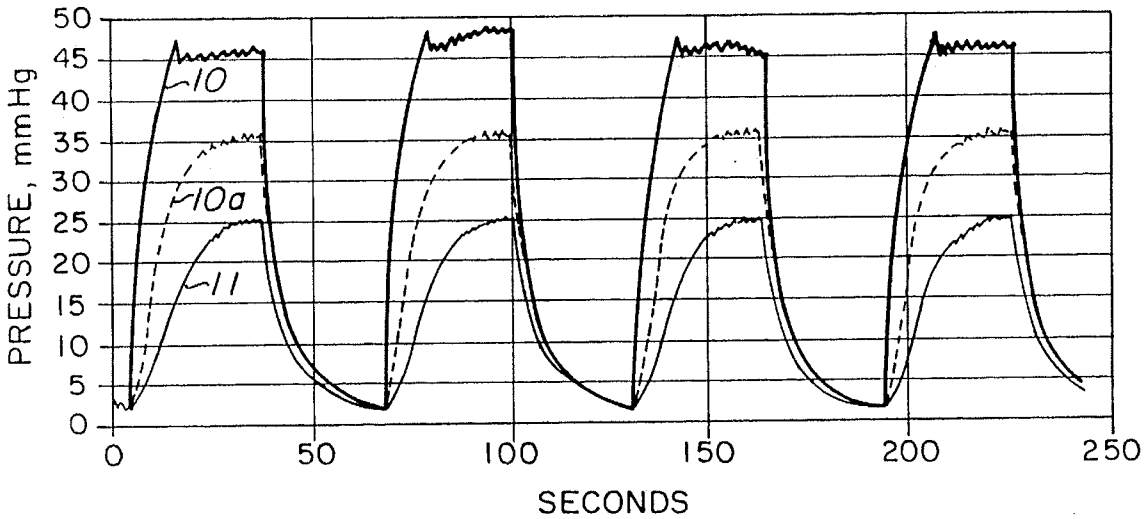
FIG. 7 is a graph illustrating the typical pressures in the three inflatable chambers of the cuff illustrated in FIG. 5.

FIG. 5 is a plan view and FIG. 6 is a cross section view of a three-inflatable chamber member 16, similar in every detail to the two inflatable chamber member or cuff 6 of FIGS. 2 and 3, but with the addition of the middle third inflatable chamber 10*a*. The chamber 18, shown on FIG. 6, is sealed within the chamber 19, which can be orally inflated through valve 9*a* as indicated earlier. The chamber 10 has the inlet connector 4 which couples to the tube 2 and air pump 1. The inflatable chamber 10*a* is inflated through the restrictor 12 from chamber 10 and inflatable chamber 11 is inflated through restrictor 12*a* from chamber 10*a*. Again, the restrictor 13 bleeds air to atmosphere at 14. The middle restrictor 12*a* is similar in size to restrictor 12. With this arrangement, and the restrictors as shown in the 3 inflatable chambers or compartments 10, 10*a*, and 11, the pressures that are developed in the three inflatable chambers are shown in FIG. 7. Thus as can be seen in FIG. 7, the pressure applied by the three compartments is graduated, intermittent and sequential.

Thus, with the present device, a relatively small air pump 1 supplies air via a single air tube 2 to the cuff with pressurized pulses, even where the cuff is multicompartment including two, three, or more inflatable chambers. The restrictor 12 that slows the rate of inflation of the second or more proximal compartment 10*a* is sealed within the first or distal compartment 10. The restrictor 12*a* that slows inflation of the third or more proximal compartment 11 is sealed within the second, less proximal compartment 10*a*, and so on.

With the present system, no separate timer or shifting air valves or multiple feed lines are required. With the present device the pressure in the second and any subsequent compartment is solely controlled by the sizing combinations of the inlet restrictors and the outlet restrictor to atmosphere. The pressure in each more proximal compartment is always less than in the preceding or more distal compartment. The amount of difference in the pressures is the function of the size of the various restrictors.

Figure 8:
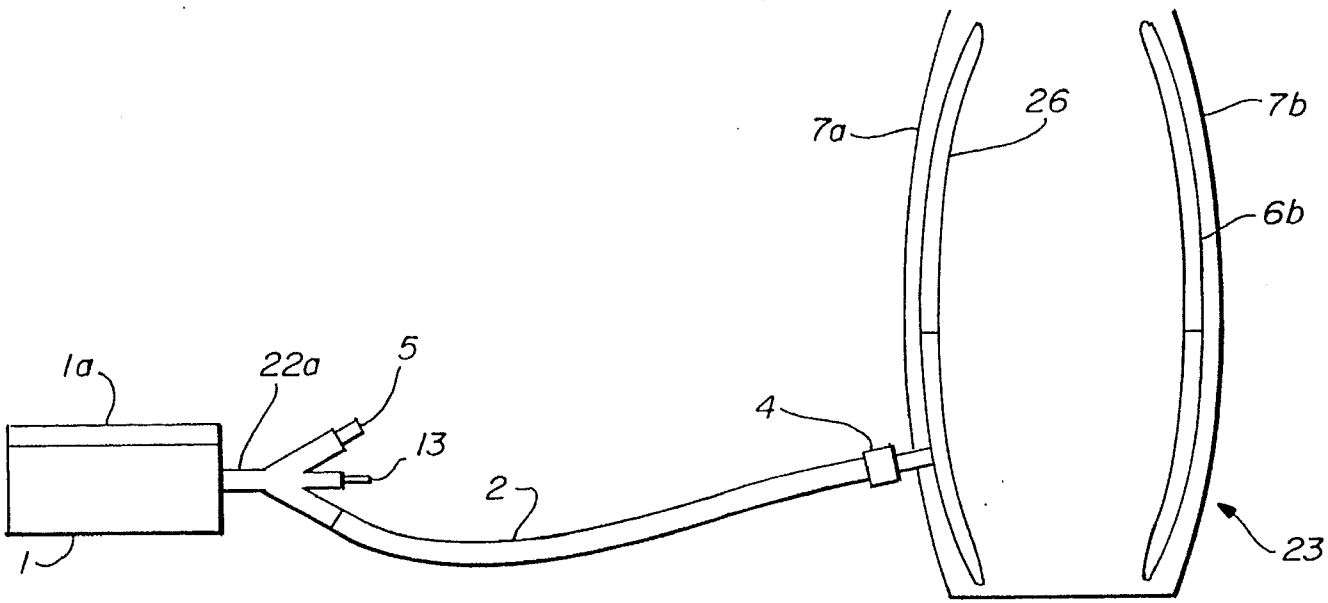
FIG. 8 is a schematic of yet another alternative system of an improved two inflatable chamber air cell.
Figure 9:
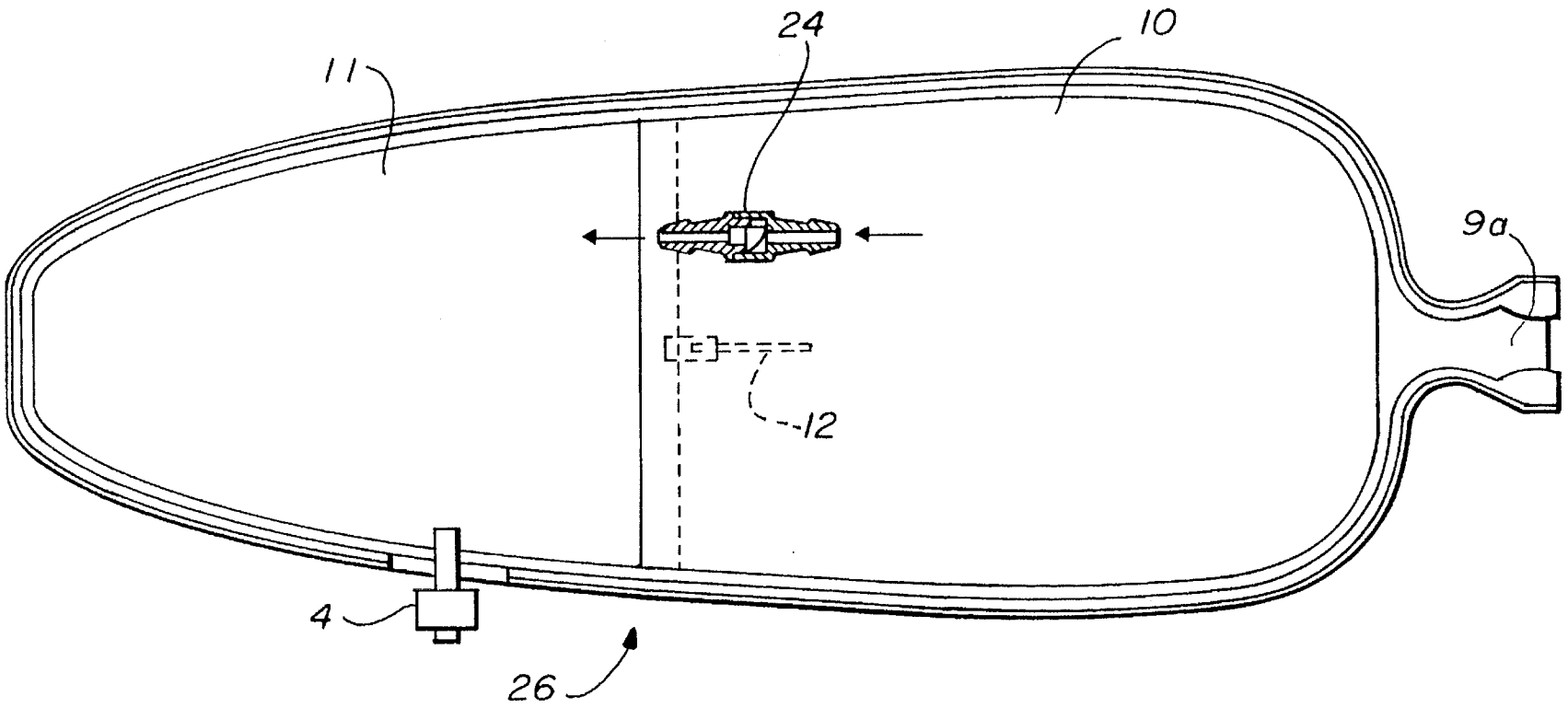
FIG. 9 is a cross-sectional view of the improved two-compartment air cell illustrated in FIG. 8.

FIG. 8 is a schematic view of yet another alternate system with an alternate form of the two-chamber air cell 26. FIG. 9 is a cross section of the two-compartment air cell 26 illustrated in FIG. 8. All of the elements of the air cell 26 are similar to the elements of the air cell 6 of the preferred embodiment illustrated in FIGS. 2 and 3, except for the restrictor 13, which bleeds air to atmosphere from chamber 11 in the preferred embodiment in FIG. 2. In FIG. 8 the restrictor is removed from the proximal compartment 11 and instead is provided as part of a three-way connector 22*a*, joining pump 1 to relief valve 5, to restrictor 13A, and to air tube 2.

A one-way check-valve 24 is disposed between the inflatable chamber 10 and 11 in air cell 26 that permits air to pass from chamber 11 to 10, but not from chamber 10 to chamber 11. With this arrangement, inflation of compartment 11 is delayed through restrictor 12, as in the preferred embodiment. But, during the deflation cycle, the one-way check-valve 14 opens permitting rapid deflation of chamber 11 through chamber 10 to atmosphere through the restrictor 13A. Without the one-way check-valve 14, pressure in the chamber 11 would reach the same pressure as in chamber 10 after a few cycles. This is because deflation of chamber 11 would be only through the restrictor 12 and it would therefore never fully deflate. The one-way check-valve 14 opens whenever pressure in chamber 11 is higher than in chamber 10. This is, of course, unnecessary with the preferred embodiment.

Using the embodiments herein, with the additional chambers on one side, with the system described in commonly assigned U.S. Pat. No. 5,125,400, allows sequential pulsation even when the pressure pump 1 is disconnected to the air cell but the patient is mobile. This occurs because, when walking, the muscles compressing the most distal chamber over simply the proximal chamber provides the pulsating compression that "milks away" the edema that often follows ankle trauma.

Thus, there has been disclosed a novel intermittent, sequential, graduated compression system a with a multi-compartment inflatable cuff by means of a simple air pump and a single air tube connecting the pump to the cuff. Each more proximal compartment of the cuff is inflated through a restrictor communicating with its adjacent more distal compartment. The maximum pressure in the most proximal compartment is limited by a restrictor bleeding to atmosphere and its pressure is always less than the pressure in the adjacent more distal compartment. The maximum pressure in the most distal compartment is controlled by a pressure relief valve. Deflation is provided through a restrictor in the most proximal chamber or compartment that is coupled to atmosphere.

In another embodiment, deflation is provided through a restrictor located in the supply line to the cuff and the deflation of each more proximal compartment is through a one-way check-valve that permits flow of air from a proximal compartment to a distal compartment but not the reverse.

Moreover, placing the inflatable chambers adjacent an exterior rigid shell minimizes "outward" expansion of the inflatable chamber, thus maximizing the amount of pressure applied to the limb. It will be apparent from the foregoing that the relative dimension of the sizes of the inflatable chambers and that of the restrictors and the pressure applied in adjacent chambers, will also control the time and amount of inflation and deflation of the chambers.

The foregoing specification describes only the invention shown or/described. Other embodiments may be provided as well. The terms and expressions used, therefore, serve only to describe the invention by example and not to limit the invention. It is expected that others will perceive differences which, while different from the foregoing, do not depart from the scope of the invention herein described and claimed. In particular any of these specific functional elements described may be replaced by any of other known elements having an equivalent function.

What is claimed is:

1. A therapeutic intermittent and sequential compression system for application to a limb comprising:

a cuff-like member adapted to be applied to the limb of a user, said member enclosing at least two inflatable chambers, a first one of said at least two inflatable chambers enveloping a second one of said at least two inflatable chambers;

a pressure source for providing intermittent pressure pulses;

a single tube coupling said pressure source to said first one of said inflatable chambers for inflating said first one of said at least two inflatable chambers at a predetermined rate during a pulse cycle;

fluid connection means coupling said at least two inflatable chambers such that the rate of inflation of said second one of the said at least two chambers is less than the rate of inflation of said first one of said at least two inflatable chambers; and fluid exhaust means for continuously exhausting the fluid in both chambers to atmosphere, said exhaust means being of a capacity small enough to permit pressurization during said pressure pulses and large enough to permit depressurization between said pulses, whereby said at least two inflatable chambers dissipate the fluid pressure in the time cycle between the intermittent pressure pulses and thereby cause said at least two inflatable chambers to deflate.

2. The therapeutic intermittent sequential compression system as in claim 1, wherein said at least two inflatable chambers further comprise:

a plurality of inflatable chambers;

adjacent ones of said plurality of inflatable chambers including a preceding inflatable chamber and a succeeding inflatable chamber;

said preceding inflatable chamber enveloping said succeeding inflatable chamber of each of said adjacent ones of said plurality of inflatable chambers; and fluid connection means coupling said preceding inflatable chamber to said succeeding inflatable chamber of each of said adjacent ones of said plurality of inflatable chambers such that the rate of inflation of said succeeding inflatable chamber is less than that of said preceding inflatable chamber so as to cause a graduated amount of compression provided by said plurality of inflatable chambers.

3. The system of claim 1, wherein said fluid connection means coupling said at least two inflatable chambers comprises a first restrictor and said fluid exhaust means comprises a second restrictor which has a flow capacity of about one fourth the volume of said first restrictor.

4. The system of claim 3 wherein said first restrictor is about 0.031" i.d. and 0.875" long and said second restrictor is about 0.031" i.d. and 3.750" long.

5. The therapeutic intermittent compression system as in claim 1, further comprising a one-way check-valve coupling said at least two inflatable chambers such that compressed fluid is allowed to pass from said second chamber to said first chamber only during a deflation cycle.

6. The therapeutic intermittent compression system as in claim 5 further comprising a restrictor valve forming part of the single tube and exhausting to atmosphere, such that during the deflation cycle said at least two inflatable chambers may be deflated.

7. The therapeutic intermittent and sequential compression system as in claim 1, wherein said cuff-like member further comprises:

a sealed chamber having a first length;

an inflatable compartment having a greater length than said sealed chamber of said first length and surrounding the sealed chamber to form an air cell; and said at least two inflatable chambers also being enclosed within said first inflatable compartment, and means separate from said pressure source for inflating said compartment to a desired level.

8. The therapeutic intermittent and sequential compression system as in claim 7, wherein said second one of said at least two inflatable chambers having a length corresponding to, and being adjacent, said sealed chamber, said first one of said at least two inflatable chambers being substantially coextensive with said inflatable compartment.

9. The therapeutic intermittent and sequential compression system of claim 7, wherein said sealed chamber includes a compressible foam member therein.

10. The system of claim 7, wherein said inflatable compartment also includes a compressible foam member disposed therein.

11. The system of claim 7, wherein said cuff-like member includes an outer wall of relatively rigid material.

12. A therapeutic intermittent compression system comprising:

a multicompartment inflatable cuff with compartments each having fluid retaining volumes being arranged one within another's fluid retaining volume from an outermost compartment to an innermost compartment in fluid receiving sequence;

a source of intermittent pressure pulses coupled with a single tube to one of said compartments; and a fluid restrictor coupled between adjacent ones of said compartments such that the pressure in succeeding ones of said compartments are always less than the pressure in preceding ones of said compartments in the sequence, and means for continuously exhausting said compartments to atmosphere, said means being of a capacity small enough to permit pressurization of said compartments during said pressure pulse and large enough to permit depressurization of said compartments between said pressure pulses.

13. An intermittent sequential compression system for engagement with at least a portion of an associated human limb, comprising:

pump means for periodically producing pulses of fluid under pressure;

cuff means adapted to be applied to the associated limb of a user;

single tube means coupling said pump means to said cuff means;

said cuff means including at least a first inflatable chamber having fluid retaining volumes and a second inflatable chamber with said second inflatable chamber being disposed within said first inflatable chamber's fluid retaining volume;

restrictor coupling means disposed between said first and second inflatable chambers, permitting constant sequential fluid communication between said chambers;

said coupling means being in communication with said first chamber; and means associated with said second chamber for permitting continuous exhaustion of fluid from said first and second chambers to atmosphere, whereby said pressure in said chamber dissipates between the intermittent pressure pulses.

14. A therapeutic intermittent and sequential compression system for application to a limb comprising:

a cuff-like member adapted to be applied to the limb of a user, said member comprising a sealed chamber having a first length, an inflatable compartment having a length greater than said first length of said sealed chamber and enclosing said sealed chamber to form an air cell, and at least two inflatable chambers also being enclosed within said inflatable compartment;

a pressure source for providing intermittent pressure pulses;

means separate from said pressure source for inflating said compartment to a desired level;

a single tube coupling said pressure source to a first one of said inflatable chambers for inflating said first inflatable chamber at a predetermined rate during a pulse cycle;

fluid connection means coupling said at least two inflatable chambers such that the rate of inflation of a second one of said chambers is less than the rate of inflation of said first chamber; and fluid exhaust means for continuously exhausting the fluid in said inflatable chambers to atmosphere, whereby said inflatable chambers dissipate the fluid pressure in the time cycle between the intermittent pressure pulses and thereby cause said inflatable chambers to deflate.

15. The therapeutic intermittent compression system as in claim 14, wherein said at least two inflatable chambers are enclosed successively one within the other from an innermost inflatable chamber to an outermost inflatable chamber, said inner most inflatable chamber having a length corresponding to and being adjacent to said sealed chamber, and said outermost inflatable chamber being substantially coextensive with said inflatable compartment.

16. The system of claim 14, wherein said sealed chamber includes a compressible foam like member therein.

17. The system of claim 16, wherein said inflatable compartment also includes a compressible foam like member disposed therein.

18. The system of claim 14, wherein said cuff-like member includes an outer wall of relatively rigid material.

* * * * *